US007321304B1

(12) United States Patent
Soffer

(10) Patent No.: US 7,321,304 B1
(45) Date of Patent: Jan. 22, 2008

(54) SECURITY TIP JAR

(76) Inventor: Allan T. Soffer, 248-5 S. Colonial Ave., Charlotte, NC (US) 28207

( * ) Notice: Subject to any disclaimer, the term of this patent is extended or adjusted under 35 U.S.C. 154(b) by 122 days.

(21) Appl. No.: 11/148,840

(22) Filed: Jun. 9, 2005

Related U.S. Application Data

(60) Provisional application No. 60/578,447, filed on Jun. 9, 2004.

(51) Int. Cl.
*G08B 13/14* (2006.01)

(52) U.S. Cl. ..... 340/571; 209/373; 209/534

(58) Field of Classification Search ..... 340/571; 209/373, 534
See application file for complete search history.

(56) References Cited

U.S. PATENT DOCUMENTS

| | | | | |
|---|---|---|---|---|
| 1,197,736 | A | | 9/1916 | Hartford et al. |
| 1,389,365 | A | | 8/1921 | Kline |
| 1,477,708 | A | | 12/1923 | Larson |
| 2,448,982 | A | | 9/1948 | Jensen |
| 4,679,691 | A | | 7/1987 | Halloran |
| 4,686,504 | A | | 8/1987 | German |
| 5,465,909 | A | * | 11/1995 | Roth ..... 232/1 D |
| 5,471,192 | A | | 11/1995 | Dash |
| 6,116,977 | A | * | 9/2000 | Tanny et al. ..... 446/8 |
| 6,454,570 | B1 | * | 9/2002 | Woods ..... 434/107 |
| 7,059,477 | B2 | * | 6/2006 | Wolf et al. ..... 209/373 |
| 2003/0209552 | A1 | * | 11/2003 | Leibner et al. ..... 220/628 |

* cited by examiner

*Primary Examiner*—Jeffery Hofsass
*Assistant Examiner*—Edny Labbees
(74) *Attorney, Agent, or Firm*—Schwartz Law Firm P.C.

(57) ABSTRACT

A security tip jar includes a vessel body and a removable base. The vessel body defines an open top designed for receiving a gratuity. The removable base forms a closed bottom of the vessel body. An electronic sensor is located in the removable base, and is adapted for sensing a disturbance of the vessel body. A protective cover is located over the electronic sensor. An alarm is operatively connected to the electronic sensor, and is adapted for activation upon disturbance of the vessel body.

19 Claims, 4 Drawing Sheets

SECURITY TIP JAR

This application is a Formal Utility Patent Application claiming priority to Provisional Patent Application Ser. No. 60/578,447 filed on Jun. 9, 2004.

TECHNICAL FIELD AND BACKGROUND OF THE INVENTION

This invention relates to a security tip jar. The invention is especially applicable for use in bars, coffee bars, restaurants, nightclubs, and other venues where gratuities are commonly offered by patrons. The invention provides security means for deterring unauthorized access to and movement of the tip jar. When activated, the security means is highly conspicuous and apparent, particularly in dimly-lit environments. The invention further provides means for acknowledging the entry of gratuity into the tip jar.

SUMMARY OF INVENTION

Therefore, it is an object of the invention to provide a security tip jar which incorporates an audible and/or visible alarm designed to alert nearby persons when the jar is touched, moved, or otherwise disturbed.

It is another object of the invention to provide a security tip jar with inherent security features to prevent unauthorized removal of gratuities entered into the jar.

It is another object of the invention to provide a security tip jar which incorporates a removable base.

It is another object of the invention to provide a security tip jar which has a narrowed or constricted neck designed to prevent unauthorized retrieval of monies deposited into the jar.

It is another object of the invention to provide a security tip jar which incorporates radio frequency identification (RFID) technology.

It is another object of the invention to provide a security tip jar which lets a bartender know when he or she has just received a gratuity.

It is another object of the invention to provide a security tip jar which draws attention to the tipping patron upon depositing a gratuity into the tip jar.

It is another object of the invention to provide a security method for curtailing gratuity theft.

These and other objects of the present invention are achieved in the preferred embodiments disclosed below by providing a security tip jar. The term "tip jar" is defined broadly herein to mean any container suitable for holding gratuities. The tip jar includes a vessel body defining an open top designed for receiving a gratuity, and a base forming a closed bottom of the vessel body. An electronic sensor is adapted for sensing a disturbance of the vessel body. An alarm is operatively connected to the electronic sensor, and is adapted for activation upon disturbance of the vessel body.

According to another preferred embodiment of the invention, the alarm includes at least one light-emitting diode.

Preferably, the alarm includes a plurality of light-emitting diodes circumferentially-spaced apart along an inside periphery of the base. The LED's are adapted for emitting light upwardly adjacent an inside wall of the vessel body.

According to another preferred embodiment of the invention, the sensor is a battery operated micro tilt sensor.

According to another preferred embodiment of the invention, the base is detachable from the vessel body.

According to another preferred embodiment of the invention, the base and the vessel body have complementary mating threads adapted for removably attaching the base and the vessel body together.

According to another preferred embodiment of the invention, the vessel body has a flared lip.

According to another preferred embodiment of the invention, the vessel body has a constricted neck.

According to another preferred embodiment of the invention, the vessel body is constructed of a substantially transparent thermoplastic material.

Preferably, the alarm activates for a time period of between 1-5 seconds upon disturbance of the vessel body.

In another embodiment, the invention is a security tip jar which includes a vessel body and a removable base. The vessel body defines an open top designed for receiving a gratuity. The removable base forms a closed bottom of the vessel body. An electronic sensor is located in the removable base, and is adapted for sensing a disturbance of the vessel body. A protective cover is positioned over the electronic sensor. An alarm is operatively connected to the electronic sensor, and is adapted for activation upon disturbance of the vessel body.

According to another preferred embodiment of the invention, the alarm comprises a plurality of light-emitting diodes circumferentially-spaced apart along an inside periphery of the base, and the protective cover has a plurality of LED openings aligned with respective light-emitting diodes.

In yet another embodiment, the invention is a security method for curtailing gratuity theft. The method includes the steps of providing a security tip jar having an open top designed for receiving a gratuity. An electronic sensor operates to sense disturbance of the tip jar. Upon disturbance of the tip jar, a security alarm is activated.

BRIEF DESCRIPTION OF THE DRAWINGS

Some of the objects of the invention have been set forth above. Other objects and advantages of the invention will appear as the description proceeds when taken in conjunction with the following drawings, in which.

DESCRIPTION OF THE PREFERRED EMBODIMENT AND BEST MODE

Figure 1:
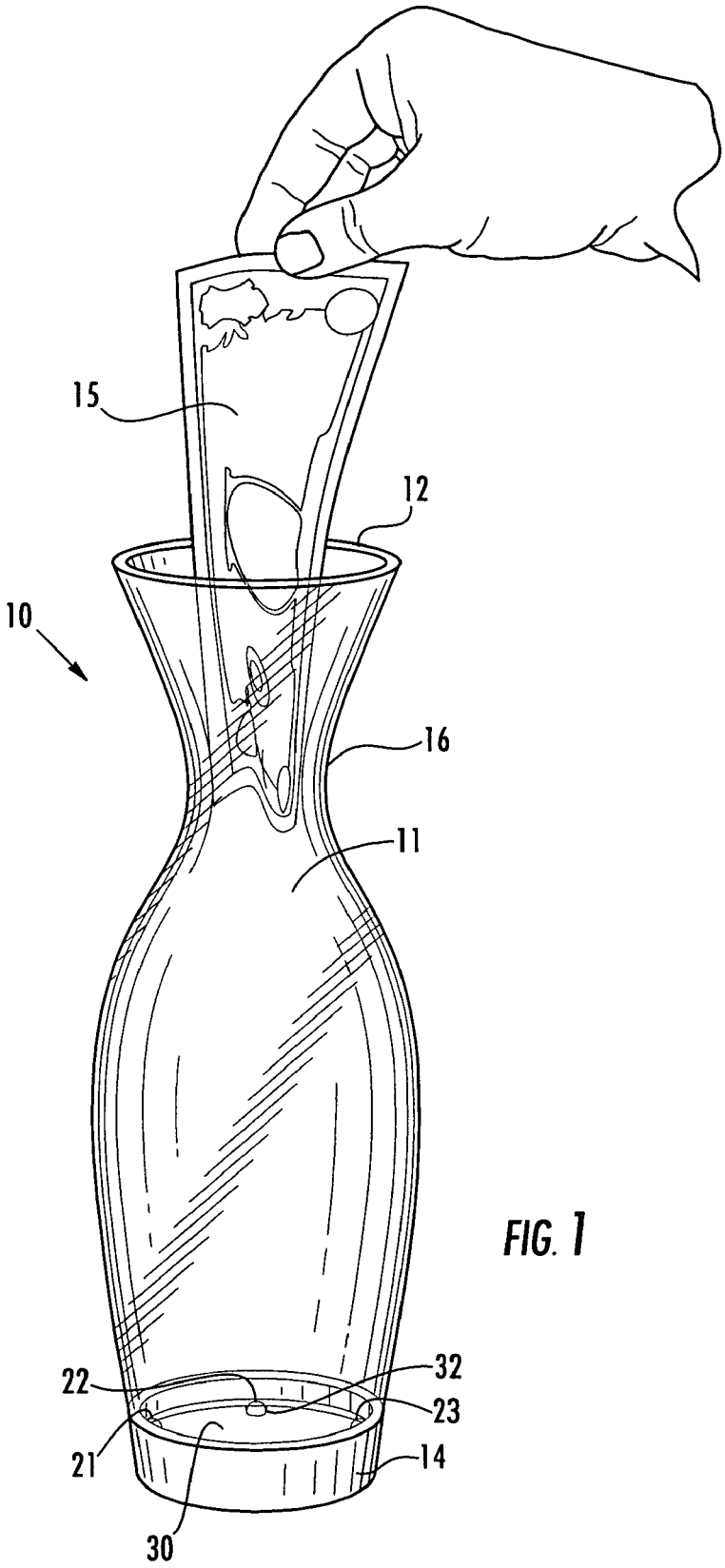
FIG. 1 is a perspective view of a security tip jar according to one preferred embodiment of the present invention, and demonstrating the insertion of paper money through an open top of the tip jar.

Referring now specifically to the drawings, a security tip jar according to the present invention is illustrated in FIG. 1, and shown generally at reference numeral 10. The tip jar 10 comprises a substantially transparent vessel body 11 with an open top 12 and a removable base 14. The open top 12 is flared outwardly for readily receiving gratuities 15, as demonstrated in FIG. 1. Paper monies 15 enter the tip jar 10 through the open top 12 and pass into a gradually constricted neck 16 of the vessel body 11. The constricted neck 16 is designed to promote gentle patting of the tip jar 10 at the open top 12 in order to push the gratuity 15 downwardly towards the larger diameter base 14. According to one embodiment, the inside diameter at the constricted neck 16 is 50% of the inside diameter at the open top 12. The length of the neck 16 at the gradual constriction is about 2-3 inches. The vessel body 11 is preferably constructed of a durable glassy thermoplastic material, such as acrylic.

Figure 2:
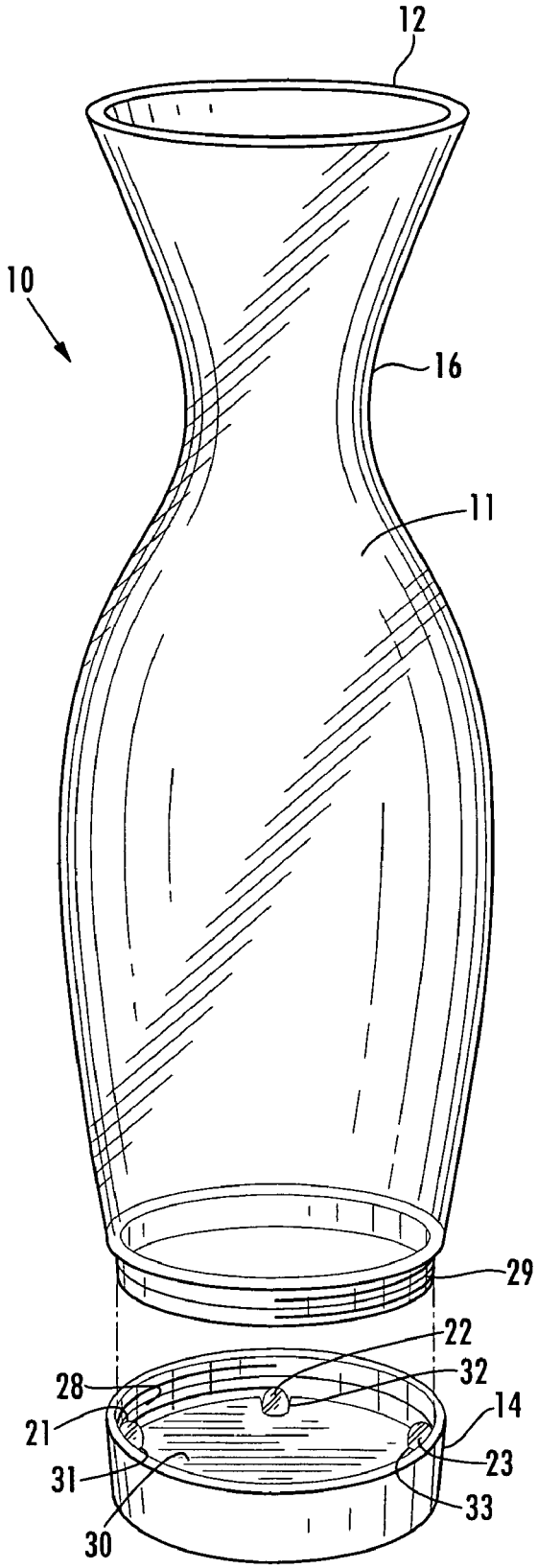
FIG. 2 is a further perspective view of the security tip jar with the base removed.
Figure 3:
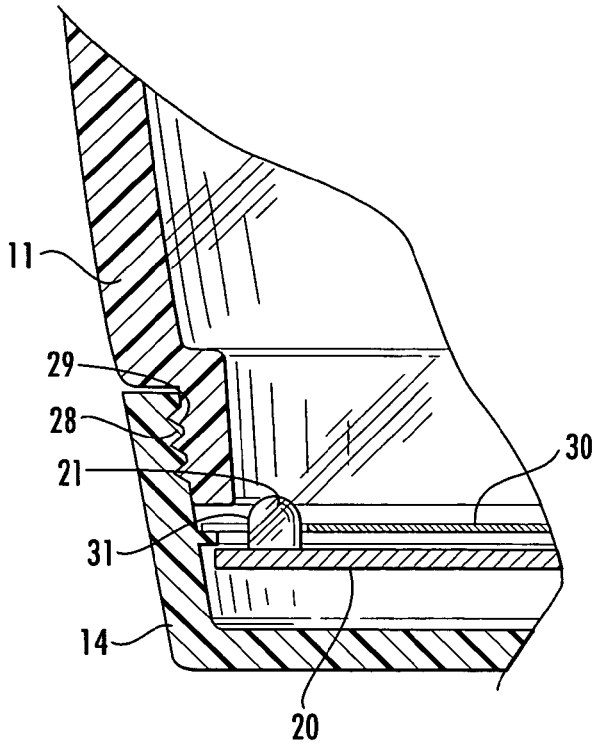
FIG. 3 is an enlarged, fragmentary, cross-sectional view of the security tip jar.
Figure 4:
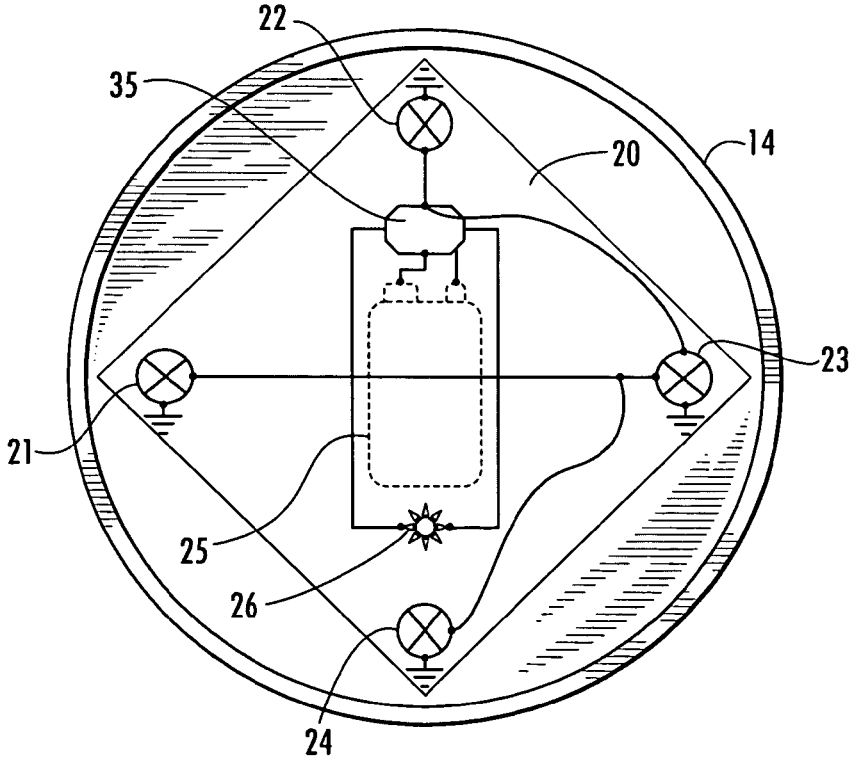
FIG. 4 is a plan view of the base with the protective cover removed to illustrate components of the circuit board.

The removable base 14 of the tip jar 10 forms a closed bottom of the vessel body 11, and is designed to house an electronic circuit board 20 carrying a number of equally spaced light-emitting diodes (LED's) 21, 22, 23, and 24, battery 25, and self-resetting micro tilt/vibration sensor 26 (See FIG. 4). As best shown in FIGS. 2 and 3, the base 14 and vessel body 11 have complementary mating threads 28, 29 which cooperate to assemble the tip jar 10, and allow convenient removal of the base 14 for purposes of collecting the gratuity 15 and accessing the circuit board 20. An unattached, protective cover 30 is preferably located between the circuit board 20 and the vessel body 11 to form a barrier between the gratuity 15 and the components of the board 20. The cover 30 has spaced-apart LED openings 31, 32, 33, and 34 (opening 34 not shown) which align with respective LED's 21, 22, 23, and 24 to allow unobstructed, upward projection of light adjacent the inside wall of the vessel body 11.

Figure 5:
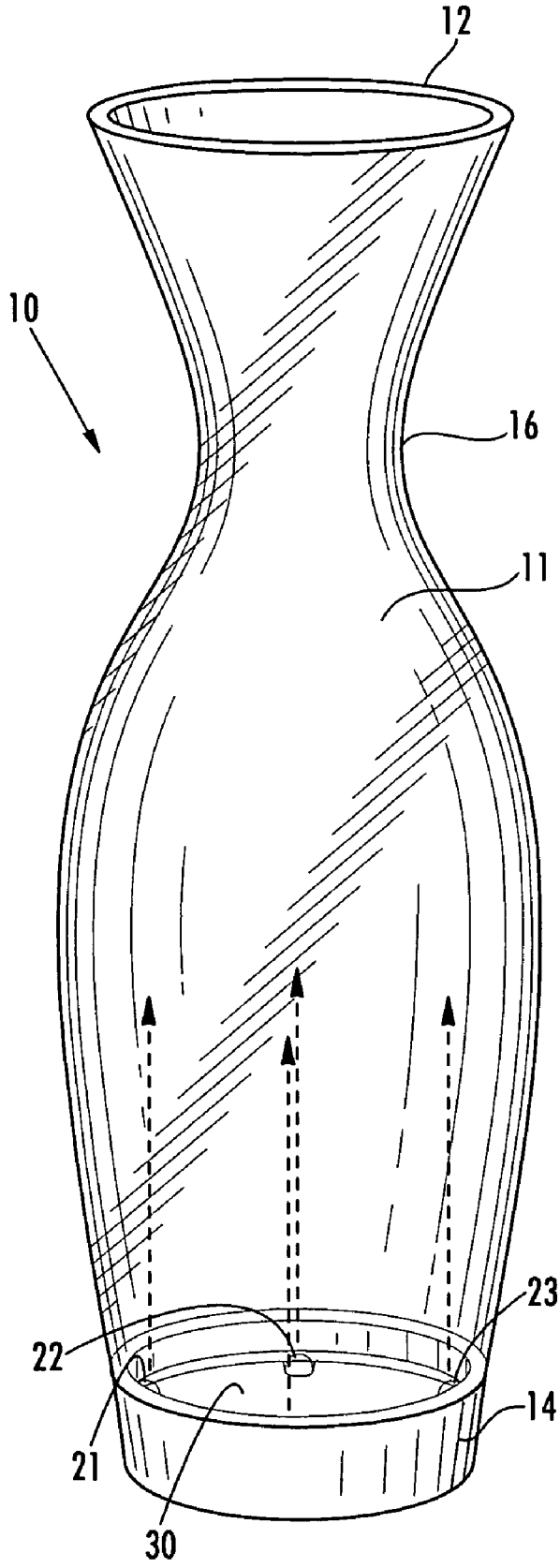
FIG. 5 is a perspective view of the security tip jar with the LED's activated to illuminate the side walls of the vessel body.

Referring to FIG. 4, the circuit board 20 is mounted on a foam pad or other support (not shown) adjacent a bottom wall of the base 14, and carries the LED's 21-24, battery 25, and micro sensor 26, as previously described. A computer chip 35 is operatively connected to the LED's 21-24, battery 25, and sensor 26. Preferably, the sensor 26 responds to any disturbance of the tip jar 10 resulting in gradual tilting or vibration of 1 degree/sec. When activated, the sensor 26 signals the computer chip 35 to direct an operating current to the LED's 21-24. The LED's 21-24 then emit an upwardly projecting light which illuminates the substantially transparent side wall of the vessel body 11, as demonstrated in FIG. 5. When its security is breached, the tip jar 10 remains illuminated for 2-5 seconds.

The security tip jar 10 is further applicable for alerting nearby persons when a gratuity is received. As paper money 15 is pushed past the constricted neck, as previously described, any touching of the vessel body 11 will activate the LED's 21-24 causing the tip jar 10 to illuminate. This enables more effective monitoring of the tip jar 10, and promotes increased security. In addition, the removable base 14 of the vessel body 11 may incorporate RFID technology which communicates with a badge or other such device (not shown) worn or carried by a nearby user to alert the user when gratuities are deposited into the tip jar 10. The alert may comprise vibration, an audible tone, brief illumination, or the like.

A security tip jar is described above. Various details of the invention may be changed without departing from its scope. Furthermore, the foregoing description of the preferred embodiment of the invention and best mode for practicing the invention are provided for the purpose of illustration only and not for the purpose of limitation—the invention being defined by the claims.

I claim:

1. A security tip jar, comprising:

a vessel body defining an open top designed for receiving a gratuity therethrough;

a base forming a closed bottom of said vessel body;

an electronic tilt sensor adapted for sensing movement of said vessel body at a rate of 1 degree per second; and an alarm operatively connected to said electronic tilt sensor, and adapted for activation in response to movement of said vessel body at a rate of 1 degree per second, whereby said alarm serves to alert nearby persons of a possible security breach involving said security tip jar.

2. A security tip jar according to claim 1, wherein said alarm comprises at least one light-emitting diode.

3. A security tip jar according to claim 1, wherein said alarm comprises a plurality of light-emitting diodes circumferentially-spaced apart along an inside periphery of said base, and adapted for emitting light upwardly adjacent an inside wall of said vessel body.

4. A security tip jar according to claim 1, wherein said base is detachable from said vessel body.

5. A security tip jar according to claim 4, wherein said base and said vessel body comprise complementary mating threads adapted for removably attaching said base and said vessel body together.

6. A security tip jar according to claim 1, wherein said vessel body comprises a flared lip.

7. A security tip jar according to claim 6, wherein said vessel body comprises a constricted neck.

8. A security tip jar according to claim 7, wherein said vessel body is constructed of a substantially transparent thermoplastic material.

9. A security tip jar according to claim 1, wherein said alarm activates for a time period of between 1-5 seconds upon disturbance of said vessel body.

10. A security tip jar, comprising:

a vessel body defining an open top designed for receiving a gratuity therethrough;

a removable base forming a closed bottom of said vessel body;

an electronic tilt sensor located in said removable base and adapted for sensing movement of said vessel body at a rate of 1 degree per second;

a protective cover located over said electronic sensor; and an alarm operatively connected to said electronic tilt sensor, and adapted for activation in response to movement of said vessel body at a rate of 1 degree per second, whereby said alarm serves to alert nearby persons of a possible security breach involving said security tip jar.

11. A security tip jar according to claim 10, wherein said alarm comprises at least one light-emitting diode.

12. A security tip jar according to claim 10, wherein said alarm comprises a plurality of light-emitting diodes circumferentially-spaced apart along an inside periphery of said base, and adapted for emitting light upwardly adjacent an inside wall of said vessel body.

13. A security tip jar according to claim 12, wherein said protective cover comprises a plurality of LED openings aligned with respective light-emitting diodes.

14. A security tip jar according to claim 10, wherein said base and said vessel body comprise complementary mating threads adapted for removably attaching said base and said vessel body together.

15. A security tip jar according to claim 10, wherein said vessel body comprises flared lip.

16. A security tip jar according to claim 15, wherein said vessel body comprises a constricted neck.

17. A security tip jar according to claim 16, wherein said vessel body is constructed of a substantially transparent thermoplastic material.

18. A security tip jar according to claim 17, wherein said alarm activates for a time period of between 1-5 seconds upon disturbance of said vessel body.

19. A security method for curtailing gratuity theft, comprising:

providing a security tip jar having an open top designed for receiving a gratuity therethrough;

electronically sensing movement of the tip jar at a rate of 1 degree per second; and upon movement of the tip jar at a rate of 1 degree per second, activating a security alarm, whereby the alarm serves to alert nearby persons of a possible security breach involving the security tip jar.

* * * * *